US007833138B1

(12) United States Patent
Fulks

(10) Patent No.: US 7,833,138 B1
(45) Date of Patent: Nov. 16, 2010

(54) APPARATUS FOR BI-DIRECTIONAL UPPER BODY EXERCISE MOVEMENTS

(76) Inventor: Kent Fulks, 9710 Amberly Dr., Dallas, TX (US) 75243

( * ) Notice: Subject to any disclaimer, the term of this patent is extended or adjusted under 35 U.S.C. 154(b) by 15 days.

(21) Appl. No.: 12/220,140

(22) Filed: Jul. 22, 2008

(51) Int. Cl.
*A63B 21/08* (2006.01)
*A63B 23/12* (2006.01)

(52) U.S. Cl. ..... 482/97; 482/100; 482/136

(58) Field of Classification Search ..... 482/56, 482/92, 97, 100, 136, 137
See application file for complete search history.

(56) References Cited

U.S. PATENT DOCUMENTS

| | | | | |
|---|---|---|---|---|
| 5,413,546 | A * | 5/1995 | Basile | 482/99 |
| 5,769,757 | A * | 6/1998 | Fulks | 482/45 |
| 5,810,701 | A * | 9/1998 | Ellis et al. | 482/136 |
| 6,302,833 | B1 * | 10/2001 | Ellis et al. | 482/100 |
| 6,500,106 | B1 * | 12/2002 | Fulks | 482/137 |
| 6,656,092 | B1 * | 12/2003 | Fulks | 482/45 |
| 6,682,466 | B1 * | 1/2004 | Ellis | 482/142 |
| 7,128,694 | B1 * | 10/2006 | Fulks | 482/94 |
| 7,128,695 | B2 * | 10/2006 | Panatta | 482/100 |
| 2002/0119871 | A1 * | 8/2002 | Fulks | 482/93 |
| 2006/0128535 | A1 * | 6/2006 | Smith | 482/94 |
| 2007/0042877 | A1 * | 2/2007 | Choi | 482/97 |

FOREIGN PATENT DOCUMENTS

| | | | |
|---|---|---|---|
| CN | 201135733 Y | * | 10/2008 |
| KR | 392526 B | * | 7/2003 |
| KR | 2003085433 A | * | 11/2003 |
| KR | 2007090801 A | * | 9/2007 |
| WO | WO 2004009184 A1 | * | 1/2004 |
| WO | WO 2004052469 A1 | * | 6/2004 |

* cited by examiner

*Primary Examiner*—Loan Thanh
*Assistant Examiner*—Victor K Hwang
(74) *Attorney, Agent, or Firm*—John F. Bryan

(57) ABSTRACT

A method and apparatus for bi-directional exercising of upper body muscle groups including the steps of mounting lever arms for pivotal movement about primary and secondary axes; arranging the axes so that they are essentially perpendicular and intersect at a shoulder of a user, wherein the user exercises by grasping the lever arms and pivoting each of them independently about both axes simultaneously moving them close together from an extended position, with resistance opposing such exercise movements.

4 Claims, 5 Drawing Sheets

APPARATUS FOR BI-DIRECTIONAL UPPER BODY EXERCISE MOVEMENTS

TECHNICAL FIELD

This invention relates generally to exercise machines, and more particularly, to exercise machines for the upper body wherein the user's movements are opposed by a selected weight.

BACKGROUND OF THE INVENTION

Many athletes and non-athletes utilize weight lifting or weight training exercises to build muscle strength and/or bulk, to prevent injury, or to improve overall condition and appearance. Typically, weight training exercises are performed with either exercise machines or free weights, i.e, barbells and weighted plates, dumbbells, etc.

Free weights offer certain advantages over exercise machines. For instance, they are relatively inexpensive in comparison to exercise machines. Free weights are also more versatile because a variety of exercises can be performed with one set of weights. On the other hand, exercise machines are usually designed for movement in a specific plane. The human body however, is by no means limited to such two dimensional movements. Thus, in an effort to replicate the benefits of multi-dimensional exercise activities, comprehensive exercise programs will incorporate both machines and free weights. In so doing, a variety of exercise routines are combined to work specific muscles and muscle groups in more than two dimensions for a more natural result.

A complex combination of muscles act for movement about the shoulder, pulling the upper arm upward and downward, forward and to the rear. To varying degrees these movements involve anterior, lateral and posterior deltoids, the trapezius, pectoral and latissimus dorsi, depending upon range and direction of movement. Since these muscles act in such diverse directions, they exemplify muscle groups which cannot be fully exercised and developed on upper body machines taught in prior art. The object of the present invention therefore, is to provide a method and apparatus for bi-directional exercise of upper body muscle groups.

SUMMARY OF THE INVENTION

The present invention addresses the aforesaid object with improved exercise methods and apparatus. Herein, according to the present invention, are disclosed exercise devices affording bi-directional resistance movements of the upper arms for exercise of the shoulder connected muscle groups. The invention relates to or employs some details well known in the arts and therefore, not the subject of detailed discussion herein.

A first embodiment of the present invention utilizes weights to provide an incrementally adjustable resistance. The apparatus has a conventional main-frame and a centrally mounted seat. A plane of symmetry extends through the middle of the frame and seat so that the two sides are mirror images with respect to a vertical mid-plane. In this embodiment, a transfer member at each side is arranged to pivot about a vertically inclined axis extending proximate the user's shoulder. A lever arm, terminating in a hand grip, is pivotally connected to the transfer member for rotation about an essentially horizontal axis that intersects the first axis at the user's shoulder. It is notable that, the vertically inclined and horizontal axes are mutually perpendicular. Right and left lever arms are mounted to pivot on these axes, with exercise force input locations displaced from the axes to provide moment arms for the exercising forces.

The pivoting movement of each transfer member is interconnected by a pulley and cable mechanism with that of the respective lever arm, so that movement about either the vertically or the horizontally inclined axis compels movement about the other axis. Such movement is opposed by an incrementally adjusted resistance. The right and left side movements need not be interconnected, inasmuch as both sides must be fully involved in order to provide a counterbalancing lateral force. Thus, the desired exercise effect is achieved whether the right and left sides are slaved to pivot together or allowed to pivot independently. If a need to interconnect the sides is perceived, it can be done mechanically.

Hand grips are oriented to effect pivotal exercise movement of the lever arms and transfer members about the generally vertical axes, while arm rests provide secondary exercising force input locations, as for facilitating pivotal exercise movement about the generally horizontal axes.

A second apparatus embodiment employing methods of the present invention is also shown to illustrate alternative means of expression. Again, this embodiment has a conventional main-frame and a centrally mounted seat, with a plane of symmetry extending through the middle of the frame and seat so that the two sides are mirror images.

A "U" shaped transfer member is mounted to the main-frame to pivot on a transverse horizontal axis at the base of its "U" shape. The transfer member also includes more or less perpendicular right and left second pivot axes intersecting the horizontal axis. Thus, the lever arms pivot vertically about the first axis and laterally or horizontally about the second axes.

Linkage members connect each lever arm to the main-frame so that, as the transfer member and lever arms pivot vertically through a given angle about the first, horizontal axis, the lever arms also pivot through similar opposing angles about second axes perpendicular to the first axis. Each lever arm has a handle, oriented to pivot the lever arms about the first axis, and an arm rest as a secondary exercising force input location, oriented to effect pivotal movement of the lever arms about the second, axes.

The method of the present inventions is enabled by either of the above embodiments. The steps of arranging first and second axes so that the first axes are essentially perpendicular to the second axes, with the axes intersecting at the user's shoulders; mounting a lever arm for pivotal movement about both first and second axes and opposing such pivotal movement with a selected resistance are necessary to the functioning of the present invention. Implementation of the invention involves the user grasping the lever arm hand grip and bearing against it and the arm rest for an exercise movement, thus forcing the lever arm to pivot about the first and second axes simultaneously. In each of the embodiments, the resistance opposing such exercise movements is adjusted by selecting an appropriate weight for the purpose.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
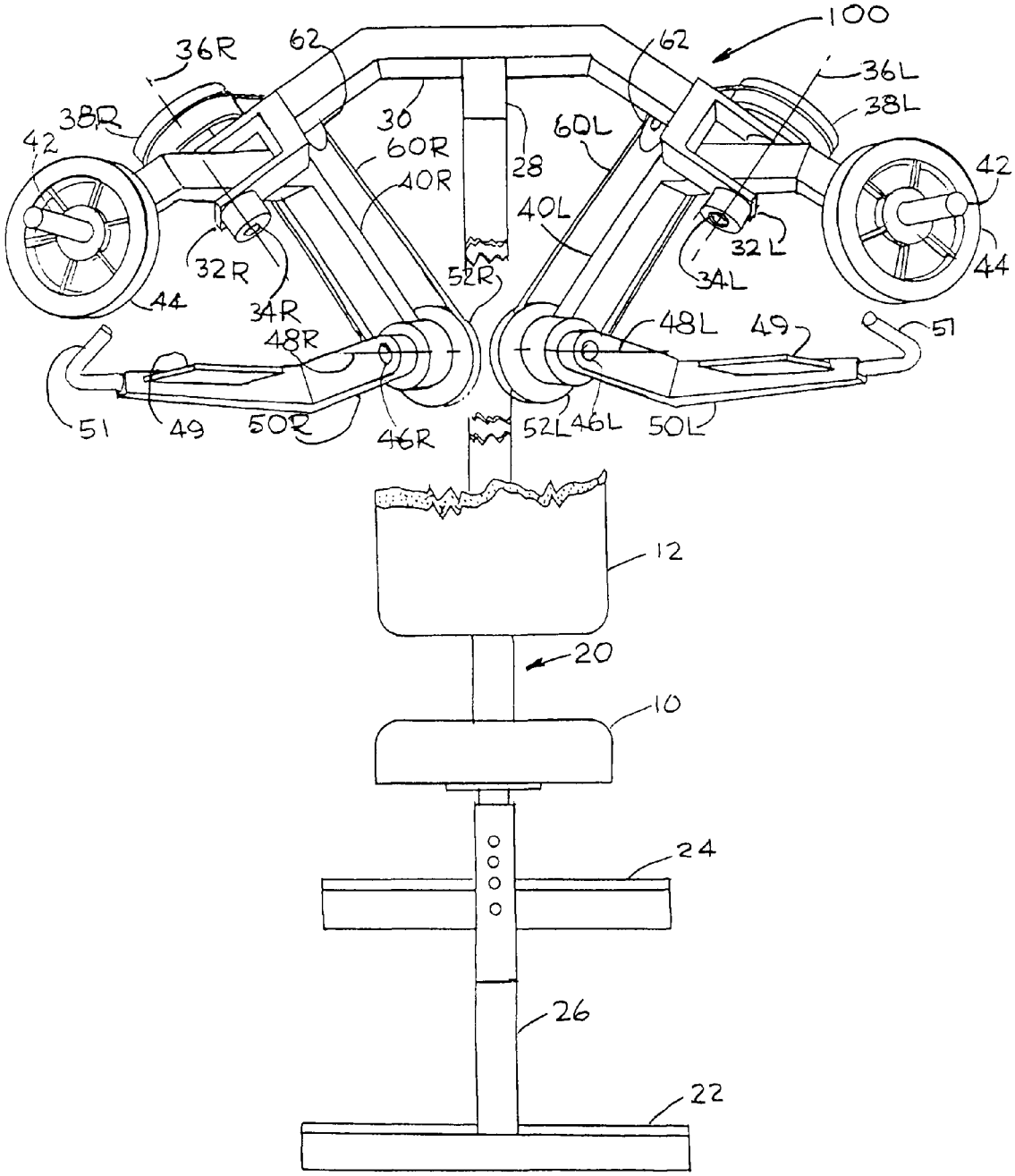
FIG. 1 is a front view of a first embodiment of a bi-directional exercise machine for the upper body according to the present inventions.

The present invention is described in the following by referring to drawings of examples of how the invention can be made and used. In these drawings, reference characters are used throughout the views to indicate corresponding parts. Note that, throughout the figures, like reference numbers are used to denote the same parts. The embodiment shown and described herein is exemplary. Many details are well known in the arts, and as such may be neither shown nor described.

Figure 2:
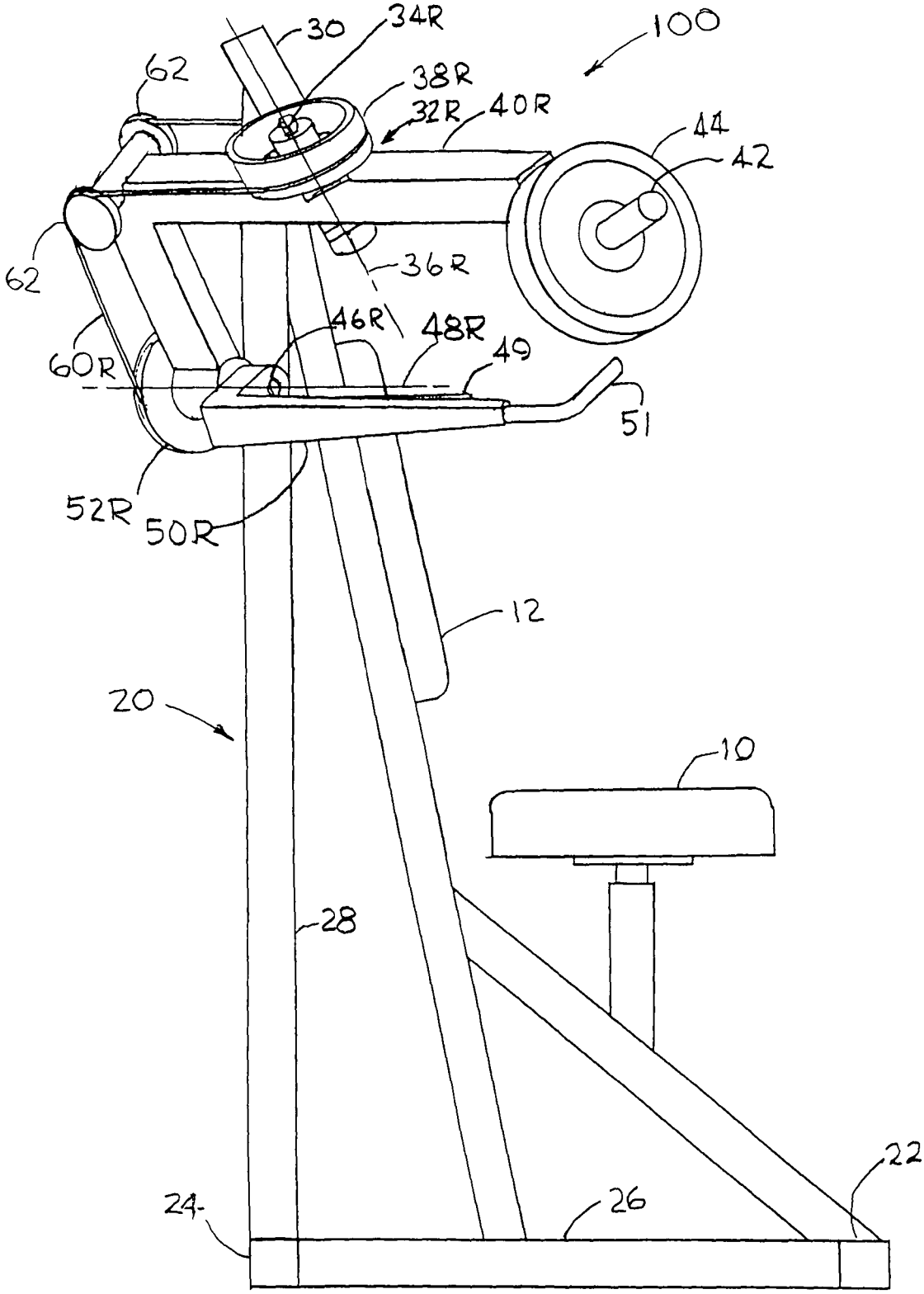
FIG. 2 is a side view of the first embodiment of FIG. 1.

FIGS. 1 and 2 illustrate a first embodiment 100 of a bidirectional exercise machine for the upper body employing the methods of the present inventions. Embodiment 100 is shown in the passive position as it appears when awaiting use. Seat 10 and seat back 12 are bisected by an imaginary vertical mid-plane that extends through the middle of main-frame 20 and the two sides of device 100 are mirror images with respect to that vertical mid-plane.

Main-frame 20 is formed of standard rectangular steel tubing, with front and rear transverse base members 22 and 24. Longitudinal base member 26 provides a "H" shaped "footprint". Column member 28 extends upwardly from rear base member 24 to support top cross member 30. Top cross member 30 extends to the right and left across the rear of embodiment 100, behind seat back 12, to terminate at each end in yokes 32R and 32L. These yokes 32R and 32L include inclined shafts 34R and 34L, directed toward seat 10 and fixedly mounted to define axes 36R and 36L. Drums 38R and 38L are fixedly mounted on shafts 34R and 34L, at the upper side of yokes 32R and 32L, respectively.

Rotatably mounted on shafts 34R and 34L are 'L" shaped transfer members 40R and 40L, with weight horns 42 at their outwardly extended ends carrying barbell plates 44 for incrementally adjusted exercise resistance. At the inner ends of transfer members 40R and 40L are lever arms 50R and 50L, mounted to shafts 46R and 46L, for pivotal movement about the initially horizontal axes 48R and 48L, respectively. Axes 48R and 48L are essentially perpendicular to inclined axes 36R and 36L and arranged so as to intersect these axes proximate the right and left shoulders of a user, as is shown in subsequent views. Lever arms 50R & 50L have hand grips 51 at the distal ends and arm rests 49 as exercise effort input locations. Also mounted on shafts 46R and 46L for rotation with lever arms 50R and 50L are lower pulleys 52R and 52L. On each side, cable members 60R and 60L pass around lower pulley 52R or 52L, over a guide pulley 62 (partially visible in FIG. 1), to fixed drum 38R or 38L and back over a companion guide pulley 62 (not visible in FIG. 1) to lower pulley 52R or 52L.

Cable members 60R and 60L are clamped to fixed drum members 38R and 38L, respectively, so that transfer members 40R and 40L are forced to pivot on shafts 34R and 34L as lever arms 50R and 50L pivot about substantially horizontal axes 48R and 48L. The limited degree of rotation allows the ends of cable members 60R and 60L to also be clamped to lower pulleys 52R and 52L, so that no slippage is possible.

Figure 3:
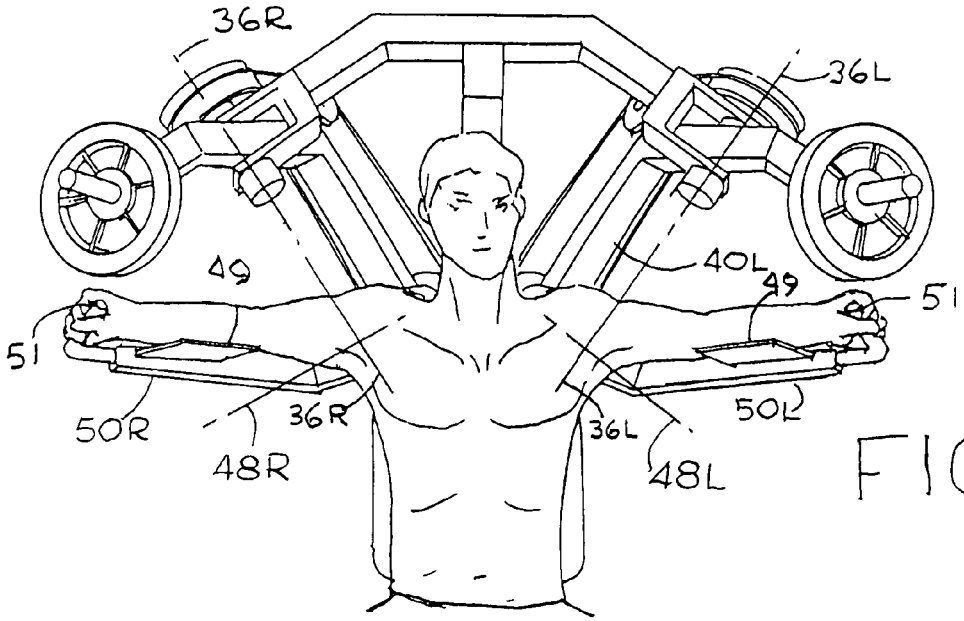
FIG. 3 is a view of the embodiment of FIG. 1 in use as it appears with the user's arms in the exercise movement starting position.
Figure 4:
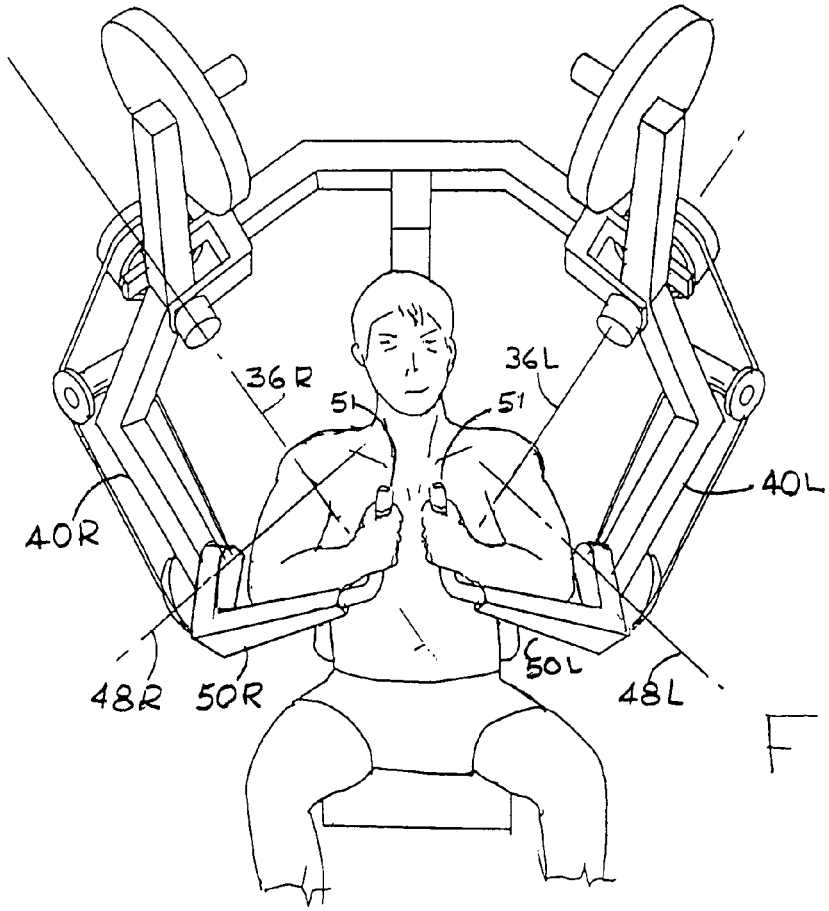
FIG. 4 is a view of the embodiment of FIG. 1 in use as it appears with the user's arms in the exercise movement finishing position.

FIGS. 3 and 4 are views of the embodiment of FIGS. 1 & 2 in use, with the exercise movement starting in FIG. 3 and finishing in FIG. 4. The user's arms are first extended as shown in FIG. 3, with hands grasping hand grips 51 and arms bearing on arm rests 49, then pulling hand grips 51 to the chest, bringing the handles close together, as shown in FIG. 4. This shows how lever arms 50R, 50L are operably connected to motion transfer members 40R, 40L respectively, to provide simultaneous pivotal movement about inclined axes 36R and 36L and substantially horizontal axes 48R, 48L. Also seen in these views is how arranging the axes so that inclined axes 36R and 36L intersect substantially horizontal axes 48R and 48L at the shoulder of the user has the effect of bringing the pectoral, latissimus dorsi and deltoid muscles into play in a completely natural manner by guiding the exercise movements along bi-directionally arcuate paths. The exercise is accomplished by selecting an appropriate weight for effective resistance, the user grasping hand grips 51 and bearing against arm rests 49, then forcing levers 50R and 50L to pivot inwardly toward column 28 and seat 20 to simultaneously pivot about axes 36R, 36L and 48R, 48L respectively.

Figure 5:
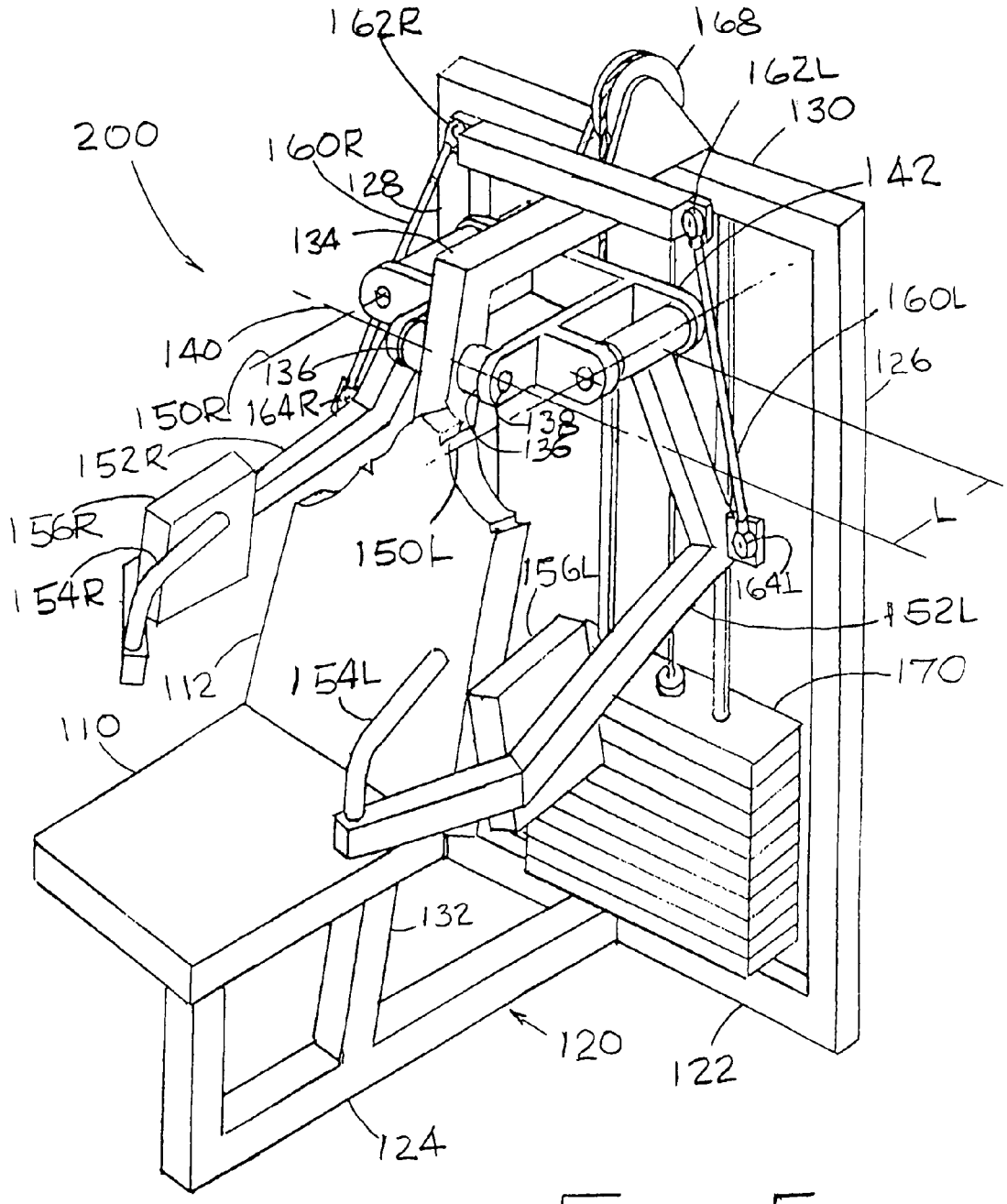
FIG. 5 PRIOR ART
FIG. 5 is a perspective view of a second embodiment of a bidirectional, upper body exercise machine according to the present inventions.

Referring now to FIG. 5, wherein is shown an alternate exercise device embodiment 200, prior art to the present invention under U.S. Pat. No. 7,128,694. Seat 110 and seat back 112 are bisected by an imaginary vertical mid-plane that extends through the middle of main-frame 120. Thus, device 200 has two sides that are mirror images with respect to the vertical mid-plane. Main-frame 120 is formed of standard rectangular steel tubing, with transverse base member 122 and longitudinal member 124 providing a "T" shaped "footprint". Perpendicular right and left members 126 and 128 extend upward at the ends of transverse base member 122 and join to transverse upper member 130. Inclined column member 132 is supported at the top by upper member 134 and fixed to base member 124. Pivotal connections 136, at the upper end of column member 132 define horizontal axis 140.

A pivoting, "U" shaped, motion transfer member 142 is connected to main frame 120 at pivotal connections 136 by shaft 138, so as to pivot about horizontal axis 140. Transfer member 142 further includes a pair of parallel or symmetrically inclined pivotal axes 150R and 150L, which are essentially perpendicular to, and effectively intersect horizontal axis 140 at the location of a user's shoulder. Right and left lever arms 152R and 152L are mounted at their proximal ends for pivotal movement about axes 150R and 150L respectively. Lever arms 152R and 152L include distal end hand grips 154R and 154L, which provide a first exercise effort input location, oriented for forcing lever arms 152R, L and subframe 142 to pivot about horizontal axis 140. Lever arms 152R, 152L each also have a second exercising effort input location in the form of arm rests 156R and 156L, oriented to effect pivotal movement of the lever arms about their respective pivotal axis 150L or 150R. Lever arms 152R, 152L are connected to main frame 120 by means of ball-jointed links 160R and 160L at connecting points 162L, 162R and 164L, 164R respectively. Weight cable 166, runs from weight stack 170, over pulley 168 and down to to transfer member 142, so as to provide selected increments of resistance for opposing exercise movements.

Figure 6:
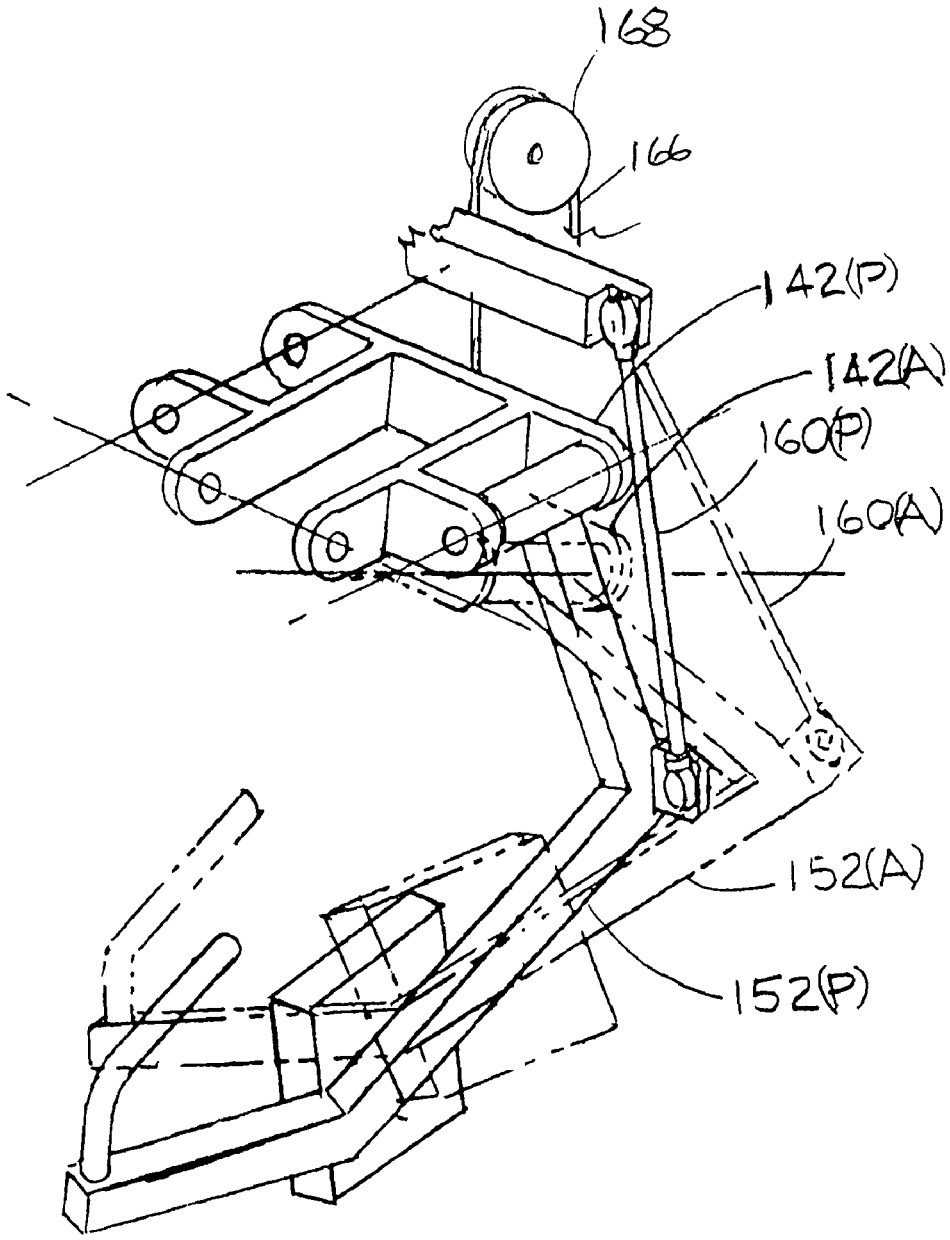
FIG. 6 PRIOR ART
FIG. 6 is a partial perspective view of the operative elements of the embodiment of FIG. 5 as it appears in the starting exercise movement position, with broken lines showing the finishing position of the exercise movement.

As can be seen in FIG. 6, wherein the active and passive positions of the operative exercise elements are designated by the suffix "(A)" or "(P)" respectively, rotation of transfer member 142 about horizontal axis 140 acts through ball-jointed connecting links 160 to cause a similar pivotal movement of lever arm assemblies 152 about their respective right or left pivotal axis 150 and the converse is also true. Weight cable 166, is attached to transfer member 142 to provide resistance to these movements as is shown in FIG. 5.

A significant aspect of embodiment 200 is that the pivotal axes 150R and 150L are essentially perpendicular to and intersect horizontal axis 140 at the user's shoulders. Varying the dimension "L" will adjust the ratio of the force required at arm rests 156 relative to that at hand grips 154. Rotation of transfer member 142 about horizontal axis 140 acts through connecting links 160 to cause a similar range of concurrent pivotal movement for lever arm assemblies 152R and 152L about their respective pivotal axes 150R, 150L.

The method of the present inventions is enabled by embodiment 100. The steps of arranging primary and secondary axes so that they are essentially perpendicular to each other and intersect at a shoulder of a user; mounting lever arms for pivotal movement about both axes and opposing such pivotal movement with selected resistances, as necessary to the functioning of the present invention. Implementation of the invention involves the user grasping the lever arm hand grips and bearing against them for an exercise movement, thus forcing the lever arms to pivot independently about both axes simultaneously. The resistance opposing such exercise movements is adjusted by selecting appropriate weights for the purpose.

It is to be understood that the methods of the above-described invention, used as described to create bi-directional upper body exercise movements may be applied in other exercise machine embodiments, so that the present inventions is not not limited to disclosed embodiments. The principle of the invention may be applied to other upper body exercise machines for pushing or pulling movements combined with lateral movement for compound exercise of muscle groups. Although preferred apparatus embodiments have been illustrated in the accompanying drawings and described in the foregoing Detailed Description, it will be understood that the methods of the inventions are not limited to the embodiments disclosed but, are capable of other expressions within the scope of the inventions described by the following claims.

I claim:

1. Apparatus for bi-directional upper body exercise movements, comprising:

a main-frame including a base and an upwardly extending column at the rear thereof supporting a transverse top cross-member;

an adjustable height seat mounted on the main-frame below the cross-member for supporting a user;

a motion transfer member having proximal and distal ends, wherein the proximal end is mounted at an outer end of the cross-member for pivotal movement about a first axis inclined toward the seat;

a lever arm, with a hand grip, mounted on the distal end of the transfer member for pivotal movement about a second axis, the second axis being essentially perpendicular to the first axis, and configured to intersect the first axis approximately where the shoulder of a user seated on the seat is located, with the lever arm and the transfer member being operably connected such that the lever arm will pivot toward the seat, about both the first and second axes simultaneously and through similar ranges of motion; and an incrementally adjustable weight opposing such pivotal movement of the lever arm about both axes, so that an exercise force must be exerted therefor.

2. The apparatus of claim 1, further comprising:

a second motion transfer member having proximal and distal ends, wherein the proximal end is mounted at the other end of the transverse cross-member for pivotal movement about a third axis inclined toward the seat;

a second lever arm with a second hand grip, mounted at the distal end of the second transfer member for pivotal movement about a fourth pivot axis, the fourth axis being essentially perpendicular to the third axis and configured to intersect the third axis where the other shoulder joint of a user seated on the seat is located, with the second lever arm and transfer member being operably connected such that the second lever arm will pivot, independently of the first lever arm, about both the third and fourth axes simultaneously, and through similar ranges of motion about both; and a second incrementally adjustable weight independently opposing such pivotal movement of the second lever arm about both axes, toward the seat.

3. Apparatus for bi-directional upper body exercise movements opposed by an incrementally set resistance, comprising:

a main frame including a first pivot axis;

a seat for a user mounted to the main frame so as to adjustably position a given user for upper body exercise movements;

a motion transfer member mounted to the main-frame for pivotal movement about the first axis, the transfer member including a second axis essentially perpendicular to the first axis and configured to intersect the first axis approximately where the shoulder of the given user seated on the seat is located;

a lever arm mounted for pivotal movement about the second axis, the lever arm including a hand grip exercise effort input location for forcing lever arm pivotal movement about both the first and second axes simultaneously through similar angular ranges; and an incrementally adjustable weight attached to the transfer member acting to oppose lever arm movement about both the first and second axes from an outwardly extended position inwardly toward the seat.

4. Apparatus for upper body exercise movements according to claim 3 wherein the apparatus is symmetrical about an imaginary vertical plane of symmetry, so as to further comprise:

right and left side motion transfer members and lever arms; and both right and left lever arms mounted to pivot independently about symmetrically disposed, essentially perpendicular axes through similar angular ranges.

* * * * *